US009706311B2

(12) United States Patent
Mao et al.

(10) Patent No.: US 9,706,311 B2
(45) Date of Patent: Jul. 11, 2017

(54) SPEAKER

(71) Applicants: LuBin Mao, Shenzhen (CN); HongXing Wang, Shenzhen (CN)

(72) Inventors: LuBin Mao, Shenzhen (CN); HongXing Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/081,864

(22) Filed: Mar. 26, 2016

(65) Prior Publication Data

US 2017/0026755 A1 Jan. 26, 2017

(30) Foreign Application Priority Data

Jul. 20, 2015 (CN) ..... 2015 2 0527399 U

(51) Int. Cl.

| | |
|---|---|
| ***H04R 1/00*** | (2006.01) |
| ***H04R 9/06*** | (2006.01) |
| *H04R 1/32* | (2006.01) |
| *H04R 7/04* | (2006.01) |
| *H04R 7/12* | (2006.01) |
| *H04R 7/20* | (2006.01) |

(52) U.S. Cl.

CPC ..... *H04R 9/06* (2013.01); *H04R 1/323* (2013.01); *H04R 7/04* (2013.01); *H04R 7/127* (2013.01); *H04R 7/20* (2013.01); *H04R 2400/11* (2013.01); *H04R 2499/11* (2013.01)

(58) Field of Classification Search

CPC ..... H04R 9/025; H04R 2499/11; H04R 9/06; H04R 1/06; H04R 2400/11; H04R 9/02; H04R 31/006; H04R 9/045; H04R 9/043; H04R 9/046; H04R 9/063; H04R 7/04; H04R 9/10; H04R 31/00; H04R 1/00

USPC ..... 381/400–412, 420–426

See application file for complete search history.

(56) References Cited

U.S. PATENT DOCUMENTS

| | | | | |
|---|---|---|---|---|
| 2013/0259289 | A1* | 10/2013 | Zhang | H04R 9/025 381/412 |
| 2014/0056464 | A1* | 2/2014 | Li | H04R 9/025 381/400 |
| 2014/0153771 | A1* | 6/2014 | Ohashi | H04R 9/025 381/412 |
| 2014/0169593 | A1* | 6/2014 | Kwon | H04R 9/043 381/185 |
| 2015/0016639 | A1* | 1/2015 | He | H04R 7/10 381/162 |

* cited by examiner

*Primary Examiner* — Md S Elahee
*Assistant Examiner* — Julie X Dang
(74) *Attorney, Agent, or Firm* — Na Xu; IPro, PLLC

(57) ABSTRACT

A speaker is provided in the present disclosure. The speaker includes a shell, a magnetic system and a vibrating system. The shell includes a cover and a frame assembled with the cover for forming a receiving cavity. The magnetic system is received in the receiving cavity for providing a magnetic gap. The vibrating system includes a diaphragm and a coil module suspended in magnetic gap, the coil module is connected to the diaphragm for driving the diaphragm to vibrate, the diaphragm includes a main body, a periphery surrounding the main body and a connecting part extending outwards from the periphery. The main body is non-coplanar with the connecting part.

15 Claims, 4 Drawing Sheets

SPEAKER

FIELD OF THE DISCLOSURE

The present disclosure generally relates to electro-acoustic converting technologies, and more particularly, to a speaker applicable to a mobile communication device.

BACKGROUND

With development of mobile communication technologies, mobile communication devices, such as smart phones and tablet personal computers, are used widely. Speakers are widely applied in the mobile communication devices for converting electrical signals into audible sounds.

A typical speaker includes a holder and a vibrating system received in the holder, the vibrating system includes a diaphragm, a dome attached on the diaphragm, and a coil module connected to the diaphragm for driving the diaphragm to vibrate and produce sound. The diaphragm includes a main body, a periphery and a connecting part, the main body is parallel to and coplanar with the connecting part.

However, with this configuration, only half of the periphery of the diaphragm can be used by the dome. Therefore, an effective radiating area of the periphery of the diaphragm is small, and this further lowers sensitivity and speech quality of the speaker.

Therefore, it is desired to provide a speaker to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and embodiments thereof.

Figure 1:
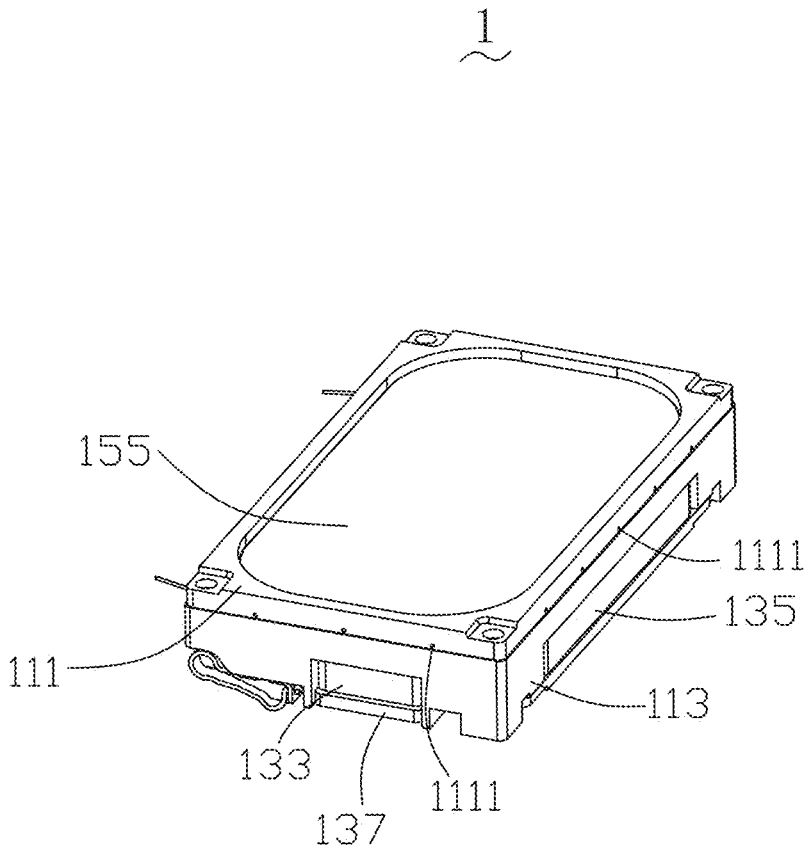
FIG. 1 is a schematic view of a speaker according to an exemplary embodiment of the present disclosure.
Figure 2:
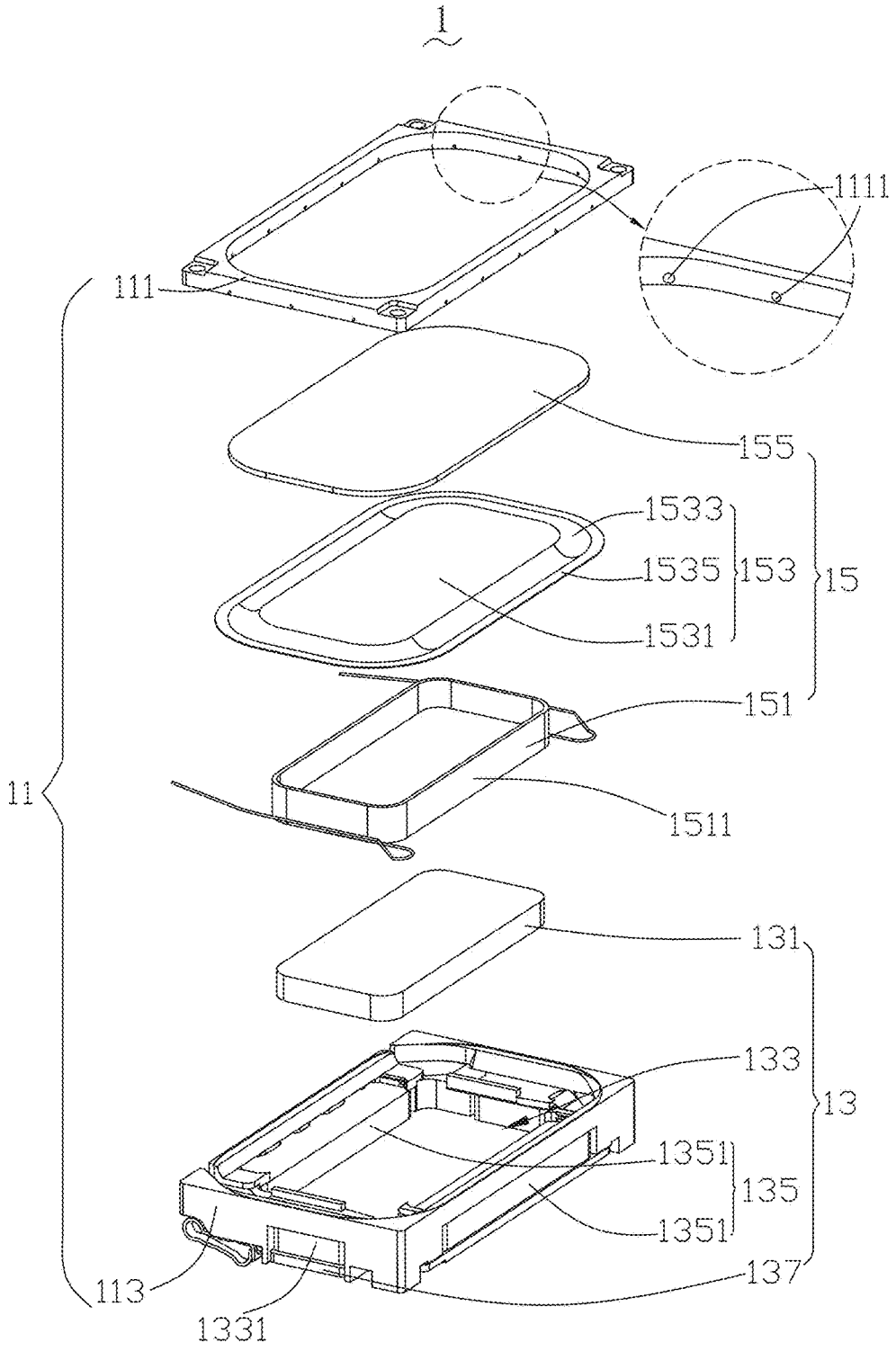
FIG. 2 is an exploded view of the speaker of FIG. 1.
Figure 4:
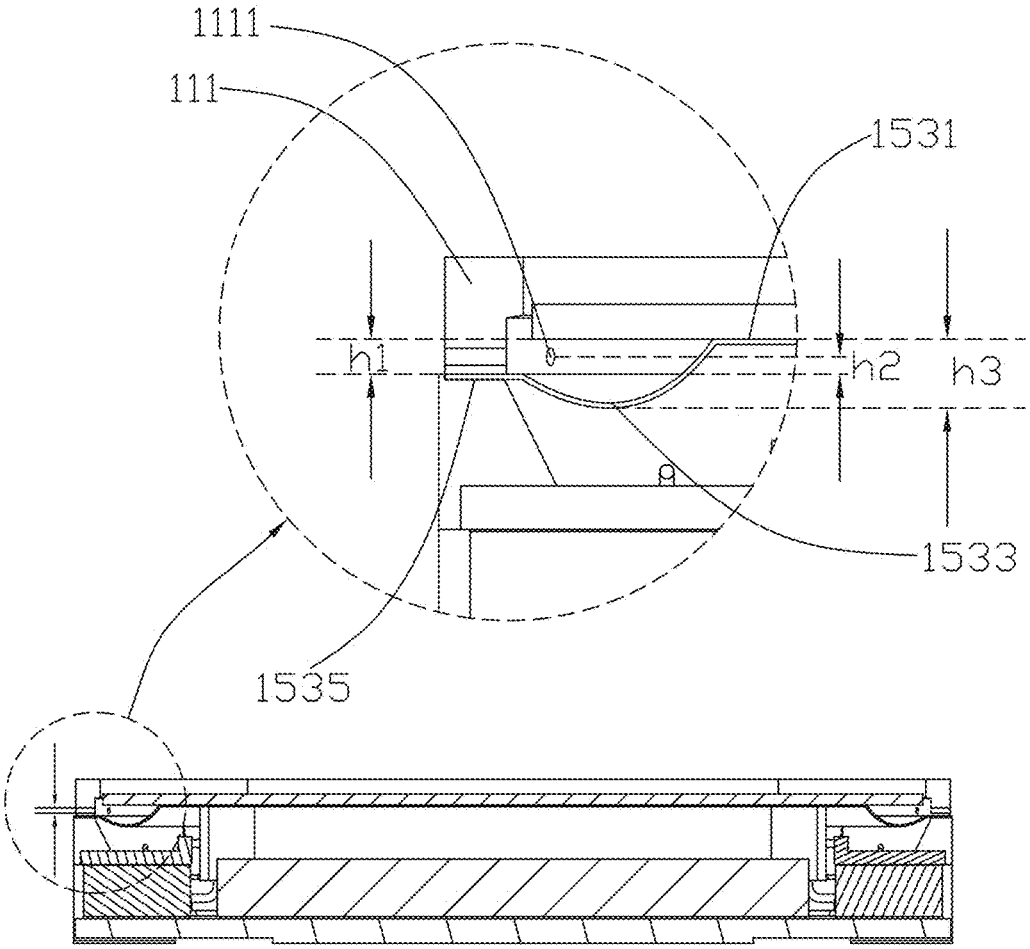
FIG. 4 is a partial, enlarged cross-sectional view of the speaker of FIG. 1.

Referring to FIGS. 1-2 and 4, a speaker 1 according to an exemplary embodiment of the present disclosure is shown. The speaker 1 includes a shell 11, a magnetic system 13 and a vibrating system 15. The shell 11 provides a receiving cavity; the magnetic system 13 and the vibrating system 15 are received in the receiving cavity.

The shell 11 includes a cover 111 with a sound outlet for outputting sound generated by the speaker 1, and a frame 113 assembled with the cover 111 for forming the receiving cavity. The cover 111 includes a plurality of air holes 1111 for providing an air venting path to balance an internal air pressure inside the shell with an ambient air pressure outside the shell 11. In the present embodiment, the air holes 1111 have a diameter approximately equal to 0.1 mm; the cover

111 has a rectangular ring-like structure, and includes sixteen air holes 1111 distributed in the front cover 111 evenly.

The magnetic system 13 includes a main magnet 131, a first magnet part 133, a second magnet part 135 and a pole plate 137. The main magnet 131 is located in a main central region of the frame 113 and surrounded by the first magnet part 133 and the second magnet part 135. In the present embodiment, the main magnet 131 has a cuboid structure with four side surfaces connected end to end; the four side surfaces may be defined as a pair of first side surfaces opposite to each other, and a pair of second side surfaces opposite to each other and perpendicular to the first side surfaces. The first magnet part 133 includes a pair of first magnets 1331 parallel to each other, which are respectively adjacent to the pair of first side surfaces of the main magnet 131. The second magnet part 135 includes a pair of second magnets 1351 parallel to each other, which are respectively adjacent to the pair of second side surfaces of the main magnet 131. The first magnets 1331 and the second magnets 1351 are arranged apart from the main magnet 131 to form a magnetic gap in the magnetic system 13. Additionally, the pole plate 137 is arranged under the main magnet 131, the first magnet part 133 and the second magnet part 135.

The vibrating system 15 includes a coil module 151, a diaphragm 153 and a dome 155. The coil module 151 includes a voice coil 1511 which may be a ring-shaped coil made of copper-clad aluminum wires, and is suspended in the magnetic gap. An end of the voice coil 1511 is connected to the diaphragm 153 to drive the diaphragm 153 to vibrate and produce audible sound.

Figure 3:
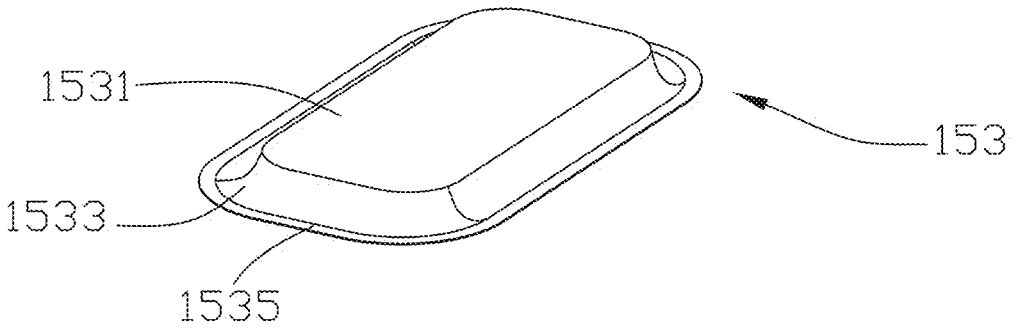
FIG. 3 is a schematic view of a diaphragm of the speaker of FIG. 2.

Referring also to FIG. 3, the diaphragm 153 includes a main body 1531, a periphery 1533 surrounding the main body 1531 and a connecting part 1535 extending outwards from the periphery 1533. The connecting part 1535 surrounds the periphery 1533, and may be sandwiched between the cover 111 and the frame 113; the periphery 1533 is connected between the main body 1531 and the connecting part 1535. In the present embodiment, the main body 1531 and the connecting part 1535 are flat, and the periphery 1533 has a curved cross section.

In addition, the main body 1531 is non-coplanar with the connecting part 1535, for example, as illustrated in FIG. 4, the main body 1531 is located in a first plane, and the connecting part 1535 is located in a second plane, the first plane is above the second plane along a positive vibrating direction of the diaphragm 153 (that is, a direction away from the magnetic system 13). In other words, a distance from the magnetic system 13 to the first plane or the connecting part 1535 is less than that to the second plane or the main body 1531.

Specifically, a first distance h1 from the first plan is located to the second plane is approximate a half of a height h3 of the periphery 1533, and the height h3 of the periphery 1533 is defined as a distance from a bottom of the periphery 1533 to the main body 1531; moreover, a second distance h2 from the air holes 1111 to the first plane is less than the first distance h1.

In the present embodiment, for example, the first distance h1 is approximately equal to 0.17 mm, the second distance h2 is approximately equal to 0.1 mm, and moreover, the height h3 of the periphery 1533 is approximately equal to 0.34 mm.

The dome 155 is attached onto the main body 1531. The dome 155 may be made of material selected from one of aluminum alloy, titanium alloy, magnesium alloy, titanium alloy composite and glass. These materials of the dome 155 can ensure the speaker 1 to generate sound with greater permeability and better gradation sense.

In the speaker 1 as provided in the present embodiment, the main body 1531 is arranged in the first plane above the connecting part 1535, and with this configuration, the dome 155 can cover and utilize an entire area of both the main body 1531 and the periphery 1533. Therefore an effective radiating area of the dome 155 can be enlarged, and sensitivity and sound quality of the speaker 1 can be improved.

Additionally, the air holes 1111 provided by the front cover 111 are configured for balancing the internal air pressure of the speaker 1 and the ambient air pressure, to ensure the air to be vented outside without being blocked by the dome 155. Therefore, reliability and a service life of the speaker 1 can also be improved.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a shell comprising a cover and a frame assembled with the cover for forming a receiving cavity;

a magnetic system received in the receiving cavity for providing a magnetic gap; and a vibrating system comprising a diaphragm and a coil module suspended in magnetic gap, the coil module being connected to the diaphragm for driving the diaphragm to vibrate;

wherein the diaphragm comprises a main body, a periphery surrounding the main body and a connecting part extending outwards from the periphery; the main body is non-coplanar with the connecting part wherein the main body is located in a first plane, and the connecting part is located in a second plane; the first plane is above the second plane along a positive vibrating direction of the diaphragm; wherein the cover comprises a plurality of air holes for providing an air venting path to balance an internal air pressure inside the shell with an ambient air pressure outside the shell.

2. The speaker as described in claim 1, wherein a distance from the magnetic system to the connecting part is less than that from the magnetic system to the main body.

3. The speaker as described in claim 1, wherein the main body and the connecting part are both flat and parallel to each other, and the periphery has a curved cross section.

4. The speaker as described in claim 3, wherein a first distance from the first plane to the second plane is a half of a height of the periphery.

5. The speaker as described in claim 4, wherein the first distance is equal to 0.17 mm, the height of the periphery is equal to 0.34 mm.

6. The speaker as described in claim 4, wherein a second distance from the air holes to the first plane is located is less than the first distance.

7. The speaker as described in claim 6, wherein the second distance is equal to 0.1 mm.

8. The speaker as described in claim 4, wherein, a diameter of the air holes is equal to 0.1 mm.

9. The speaker as described in claim 1, wherein the vibrating system further comprises a dome attached onto the main body of the diaphragm.

10. The speaker as described in claim 9, wherein the dome covers an entire area of both the main body and the periphery of the diaphragm.

11. The speaker as described in claim 9, wherein the dome is made of material selected from one of aluminum alloy, titanium alloy, magnesium alloy, titanium alloy composite and glass.

12. The speaker as described in claim 1, wherein the magnetic system includes a main magnet, a first magnet part and a second magnet part, the main magnet is located in a main central region of the frame and surrounded by the first magnet part and the second magnet part, the first magnet part and the second magnet part are arranged apart from the main magnet to form the magnetic gap.

13. The speaker as described in claim 12, wherein the magnetic system further comprises a pole plate, the pole plate is arranged under the main magnet, the first magnet part and the second magnet part.

14. The speaker as described in claim 12, wherein the coil module comprises a voice coil, the voice coil is a ring-shaped coil suspended in the magnetic gap.

15. The speaker as described in claim 14, wherein the coil module is made of copper-clad aluminum wires.

* * * * *